US011328630B1

(12) United States Patent
Hairston-Wilson et al.

(10) Patent No.: US 11,328,630 B1
(45) Date of Patent: May 10, 2022

(54) MODULAR COLLAPSIBLE SHADOWBOX SYSTEM

(71) Applicants: Renee Hairston-Wilson, Claremore, OK (US); Kendel Stocker, Claremore, OK (US)

(72) Inventors: Renee Hairston-Wilson, Claremore, OK (US); Kendel Stocker, Claremore, OK (US)

( * ) Notice: Subject to any disclaimer, the term of this patent is extended or adjusted under 35 U.S.C. 154(b) by 0 days.

(21) Appl. No.: 17/015,574

(22) Filed: Sep. 9, 2020

Related U.S. Application Data

(60) Provisional application No. 62/897,685, filed on Sep. 9, 2019.

(51) Int. Cl.
*G09F 13/04* (2006.01)
*G09F 15/00* (2006.01)

(52) U.S. Cl.
CPC ..... *G09F 13/0413* (2013.01); *G09F 15/0062* (2013.01); *G09F 13/0463* (2021.05)

(58) Field of Classification Search
CPC ..... G09F 13/0413; G09F 13/0463; G09F 15/0062
See application file for complete search history.

(56) References Cited

U.S. PATENT DOCUMENTS 4,854,060 A * 8/1989 Corbo ..... A47G 1/141 40/720
6,493,972 B1 * 12/2002 Williams ..... G02B 30/27 40/454
2002/0124451 A1 * 9/2002 Ong ..... A47G 1/14 40/720
2002/0133994 A1 * 9/2002 Vincent ..... A47G 1/14 40/720
2006/0123678 A1 * 6/2006 Arvin ..... G09F 13/0413 40/547
2008/0172918 A1 * 7/2008 Weiss ..... A47G 33/02 40/720
2011/0010973 A1 * 1/2011 Monti ..... G09F 13/005 40/564
2011/0185609 A1 * 8/2011 Miedema ..... F21S 2/005 40/559
2013/0074386 A1 * 3/2013 Santarelli ..... G09F 23/06 40/606.01
2015/0310780 A1 * 10/2015 Anders ..... G09F 19/228 40/606.01
2018/0075787 A1 * 3/2018 Frey ..... G09F 15/0018

* cited by examiner

*Primary Examiner* — Gary C Hoge
(74) *Attorney, Agent, or Firm* — Head, Johnson, Kachigian & Wilkinson, PC

(57) ABSTRACT

A modular collapsible shadowbox system for creating customizable decorative tables. The system comprises a plurality of individual units, each displaying a letter, number, symbol, or shape, which, when combined, form a desired word, phrase, expression, or design. The units may be folded for storage and transport, then assembled in any desired combination for use. The desired units may be aligned in a row with a tabletop secured thereon for use as a table. The units may be individually lit from within, backlighting the letter, number, symbol, or shape and creating a shadowbox effect. The individual units, combined with color-customizable lighting, allow a user to create a custom table with any desired message and color scheme and is thus ideal for weddings, parties, and other events.

13 Claims, 18 Drawing Sheets

MODULAR COLLAPSIBLE SHADOWBOX SYSTEM

CROSS REFERENCE

This application is based on and claims priority to U.S. Provisional Patent Application No. 62/897,685 filed Sep. 9, 2019.

BACKGROUND OF THE INVENTION

Field of the Invention

This invention relates generally to a modular collapsible shadowbox system, and more particularly, but not by way of limitation, to a system for creating customizable decorative tables comprised of individual units, each displaying a letter, number, or symbol, which, when combined, form a desired word, phrase, or expression.

Description of the Related Art

It is common practice for consumers to decorate by a theme or color scheme for special events such as weddings, birthdays, parties, religious celebrations, or other events. Often, event venues do not provide furniture such as tables and chairs, leaving consumers to source party furniture themselves. Consequently, consumers have begun to turn the burden of sourcing party furniture into a decorative opportunity. Sourcing furniture such as tables and chairs that match the decorative theme or color scheme of the party is an increasingly common occurrence.

In response, party supply rental companies often provide—alongside a range of all-purpose furniture—a selection of decorative tables which can be used to match the decorative theme of certain events such as wedding receptions and birthday parties. On a smaller scale, party planners also offer furniture rentals specific to the types of events they plan.

Similar practices have been done with other smaller items such as offering a broad range of dishware, placemats, decorations, and other elements which could be selected by the consumer to fit an event's decorative theme or color scheme. However, tables and chairs are significantly more expensive and occupy a considerable amount more space than place settings and decorative items. Therefore, party supply companies face considerable challenges when trying to offer a wide selection of large, expensive decorative tables which caters to every consumer's type of event, decorative theme, or color scheme.

Based on the foregoing, it is desirable to provide a fully customizable decorative table which could be configured to be used at any type of special event.

Further, it is desirable that the decorative table be foldable for ease of storage and for ease of transport to and from the event site.

Finally, it is desirable that the decorative table be lit with color changing lights in order to allow a single table to cater to any decorative theme or color scheme in which it is used.

SUMMARY OF THE INVENTION

In general, in a first aspect, the invention relates to a modular system for customized tables and other decorations. The system may comprise a plurality of units, where each unit has a rectangular cuboid shape when assembled, is hollow, and comprises a front panel with a decorative shape, such as a letter, a number, a symbol, or a shape. Each unit in the system may have the same height and depth and the units may be capable of being used in combination.

The modular system may further comprise at least one table top, where the plurality of units are capable of being aligned side-by-side in a row with the table top resting atop the units. The table top may be connected to at least one of the units. The table top may be glass, and the system may further comprise at least one metal glass connector capable of connecting the table top to at least one of the units.

Each unit may be foldable. Each unit may further comprise: a bottom panel, where the bottom panel is flat and rectangular and has a right side, a left side, a front side, and a back side; a top panel with the same dimensions as the bottom panel, where the top panel is flat and rectangular and has a right side, a left side, a front side, and a back side; a right-side panel, where the right-side panel is flat and rectangular and has a front side, a back side, a top side, and a left side, where the top side of the right-side panel is removably connected to the right side of the top panel and the bottom side of the right-side panel is removably connected to the right side of the bottom panel; a left-side panel with the same dimensions as the right-side panel, where the left-side panel is flat and rectangular and has a front side, a back side, a top side, and a left side, where the top side of the left-side panel is removably connected to the left side of the top panel and the bottom side of the left-side panel is removably connected to the left side of the bottom pane; and a back panel with the same width as the top and bottom panels and the same height as the right-side and left-side panels, where the back panel is flat and rectangular and has a top side, a bottom side, a right side, and a left side, where the top side of the back panel is connected to the back side of the top panel, the bottom side of the back panel is connected to the back side of the bottom panel, the right side of the back panel is connected to the back side of the right panel, and the left side of the back panel is connected to the back side of the left panel. The back panel may be connected to the top panel, the bottom panel, the right-side panel, and the left-side panel via a plurality of hinges, such as living hinges. The side panels may be removably connected to the top and bottom panels via a plurality of reclosable fasteners.

The front panel may have the same width as the back, top, and bottom panels and the same height as the back, right-side, and left-side panels. The front panel may be removably connected to the front side of the top panel at at least one point; the front side of the bottom panel at at least one point; the front side of the right-side panel at at least one point; and the front side of the left-side panel at at least one point. The front panel may be removably connected to the top, bottom, and side panels via a plurality of reclosable fasteners.

The modular system may further comprise a plurality of light sources, where each unit has a light source within the unit capable of backlighting the decorative shape of the front panel. The light sources may be a plurality of battery-powered LED dome lights.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a modular system for assembling customized tables and other decorations for weddings, parties, and other events. The same system may be used for other items, as well, for which modular assembly and customization is desired.

Figure 1:
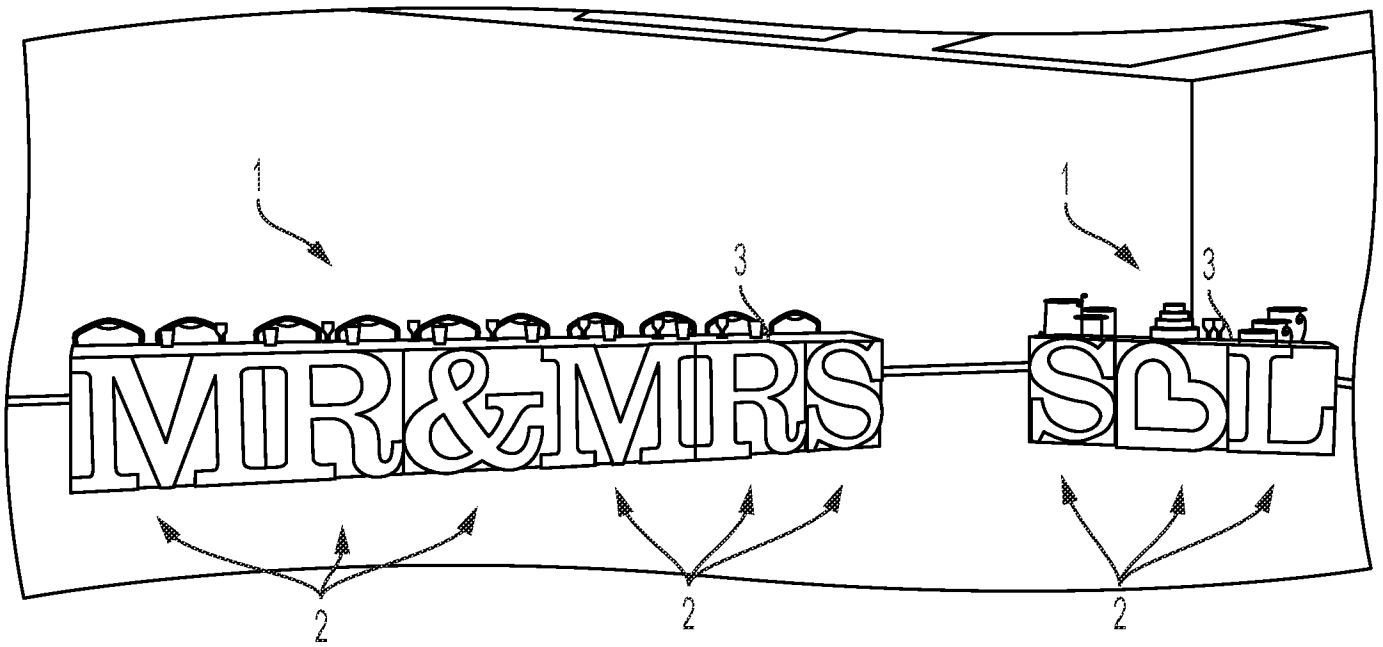
FIG. 1 is a perspective view of two tables assembled using the system of the present invention.
Figure 2:
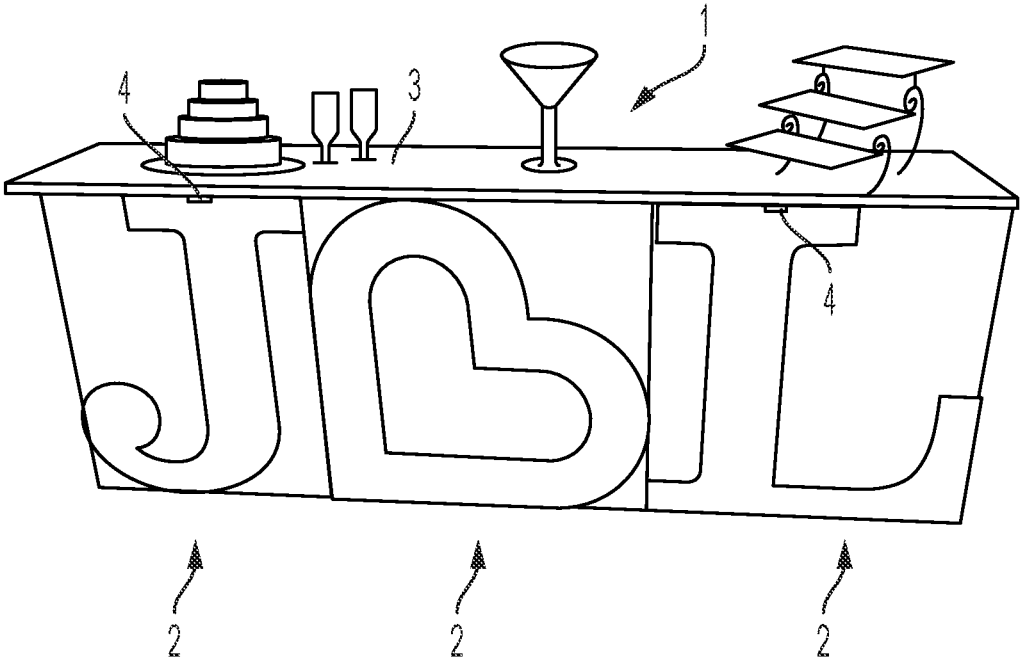
FIG. 2 is a perspective view of another table assembled using the system.
Figure 3:
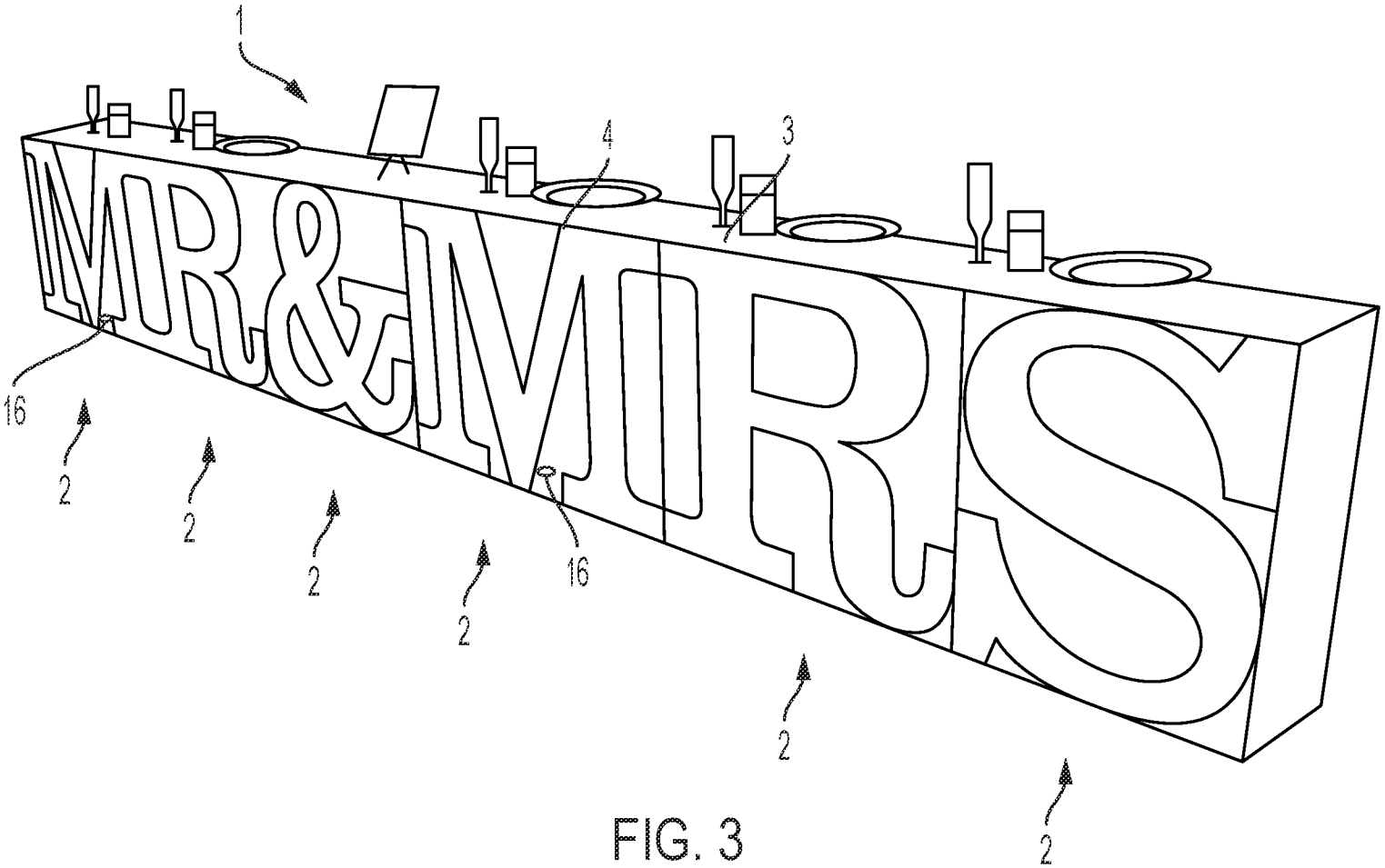
FIG. 3 is a perspective view of another table assembled using the system.
Figure 4:
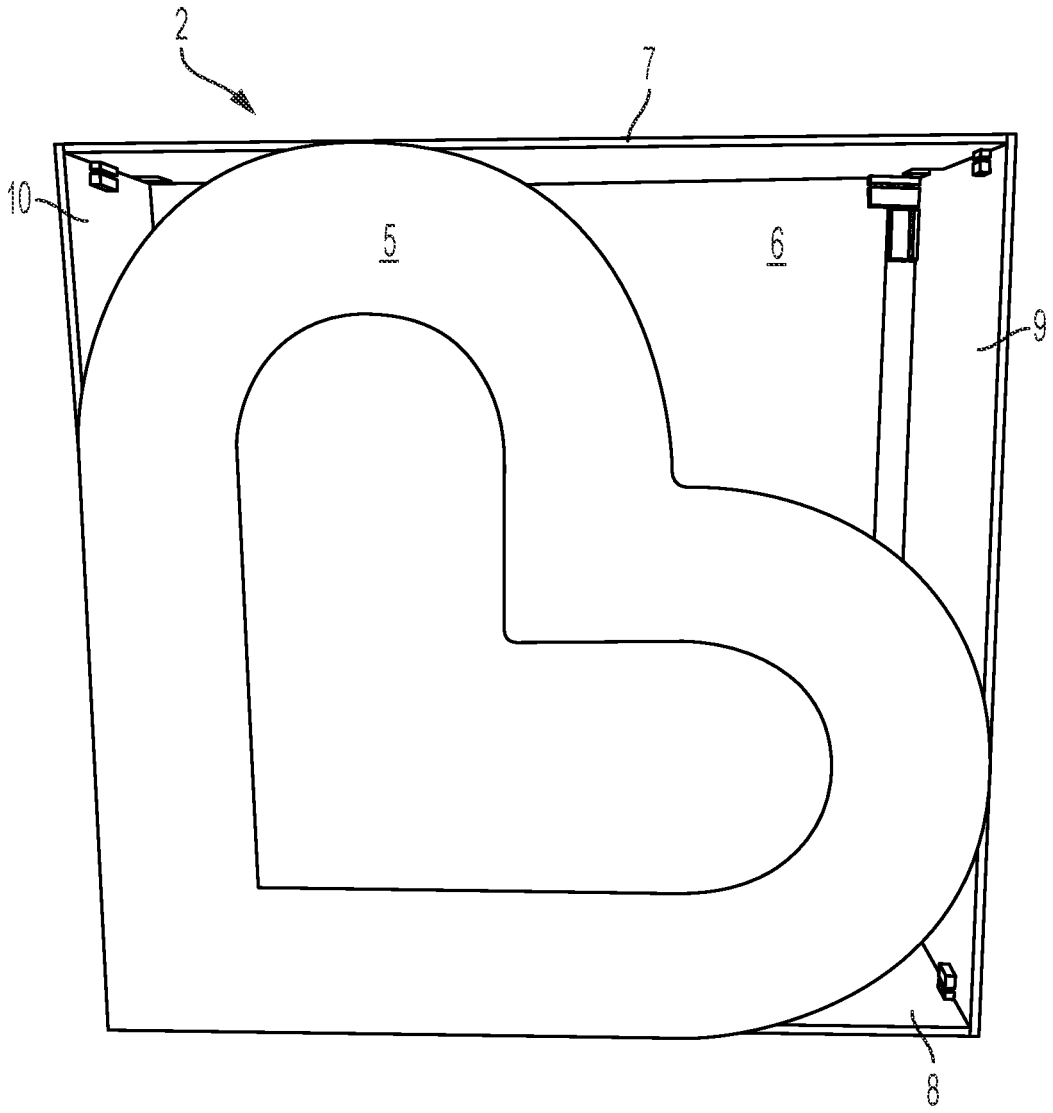
FIG. 4 is a front view of one unit of the system.
Figure 5:
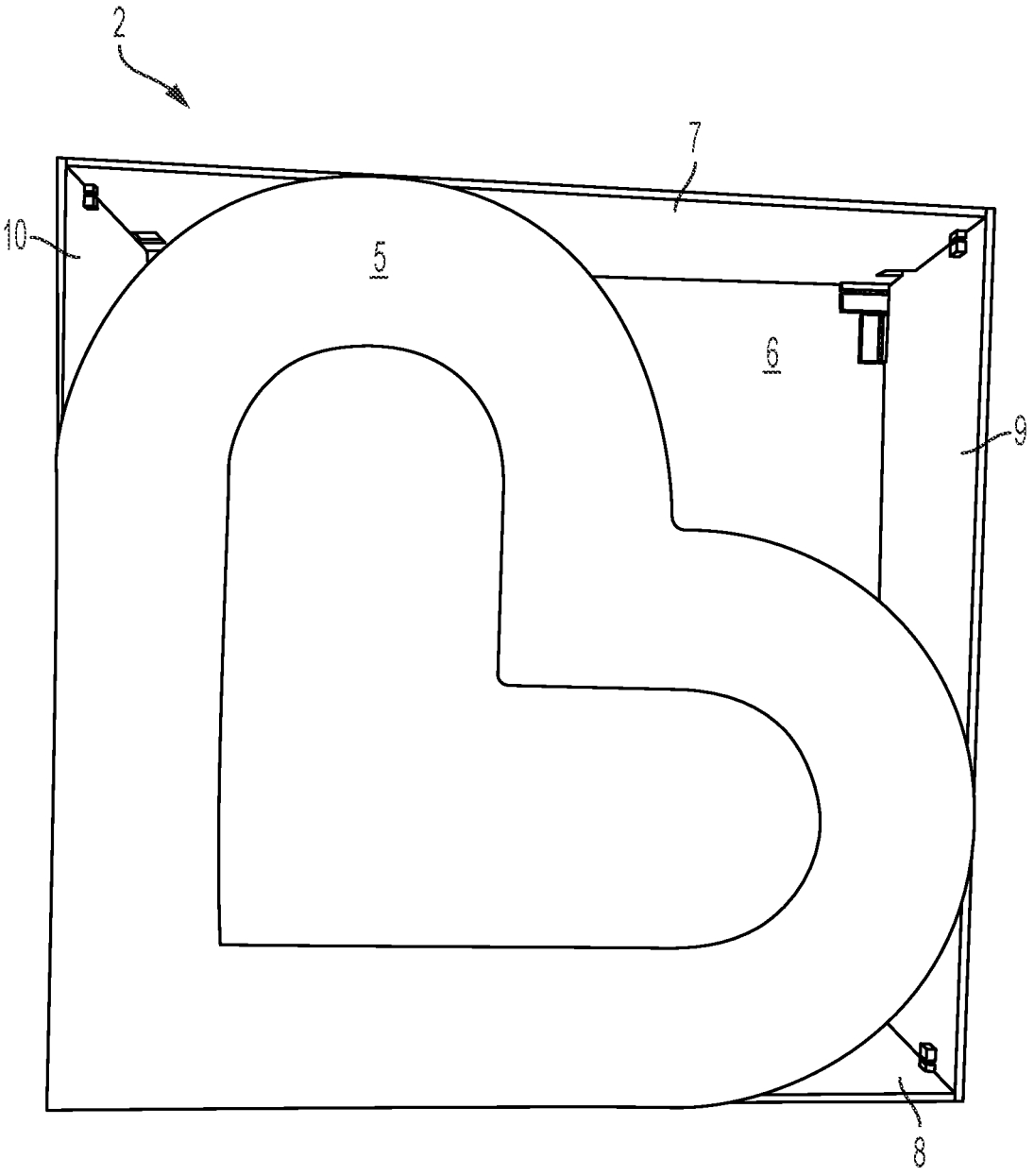
FIG. 5 is a front view of the unit with alternate lighting.
Figure 6:
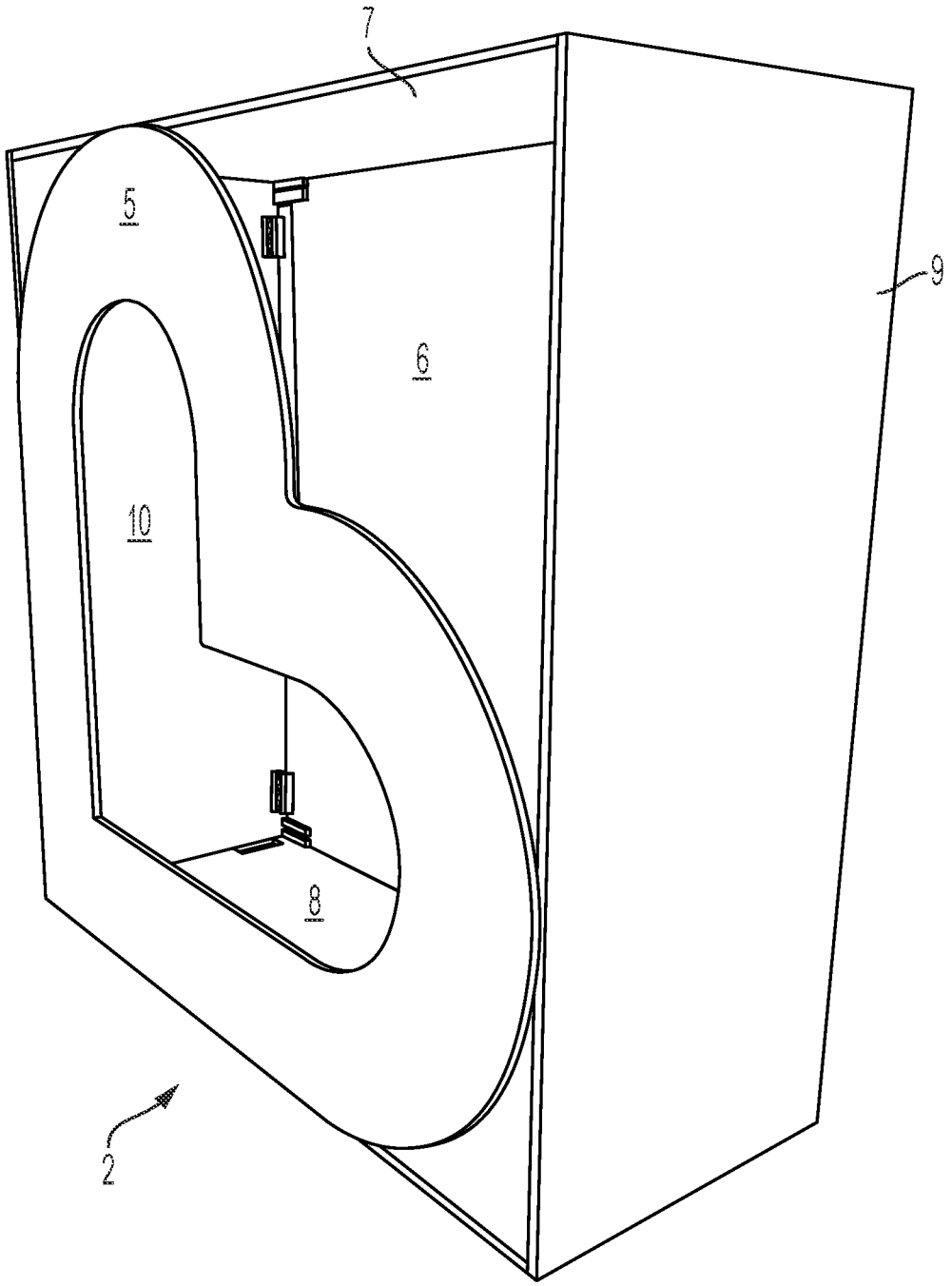
FIG. 6 is a side perspective view of the unit.
Figure 7:
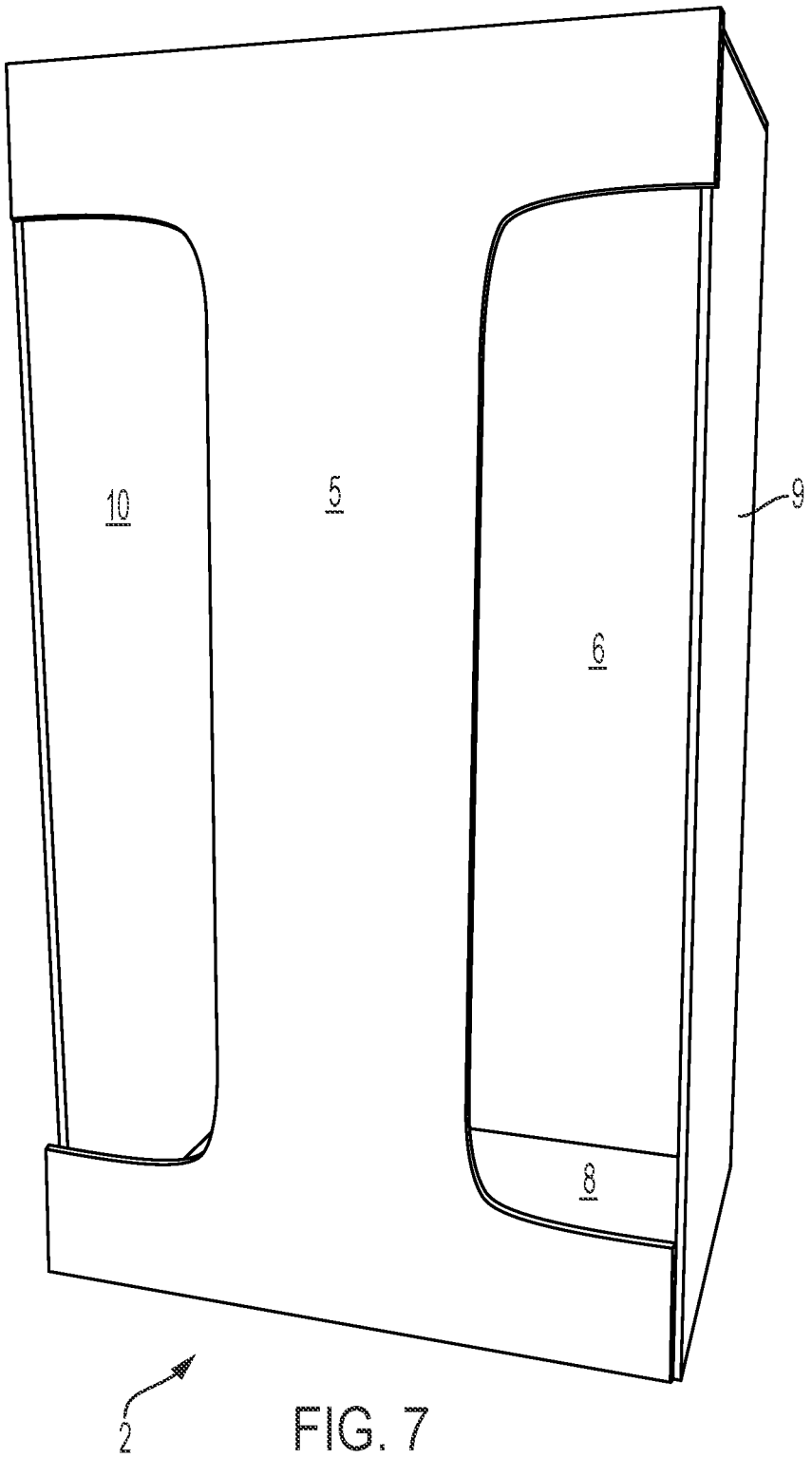
FIG. 7 is a front view of another unit of the system.
Figure 8:
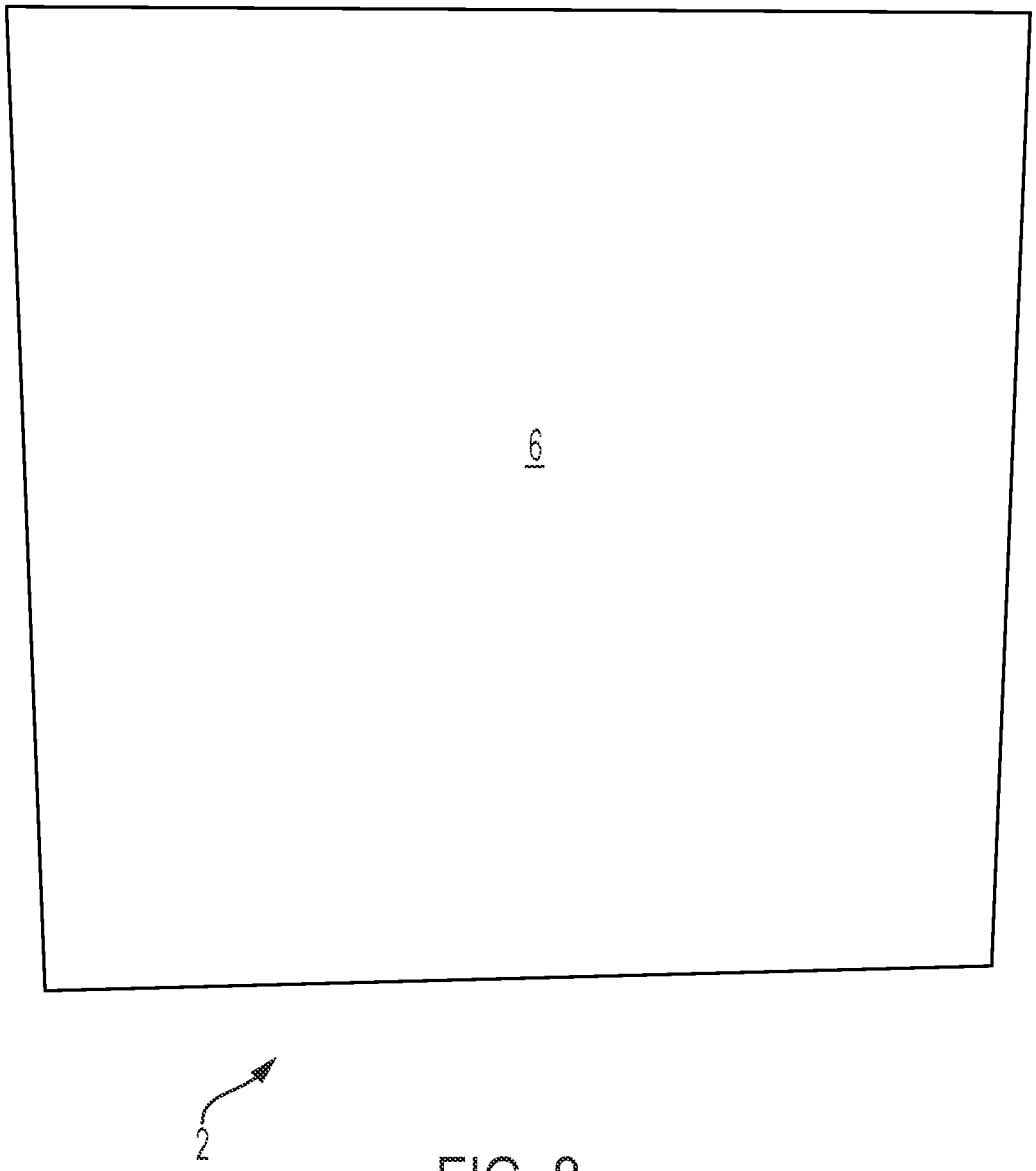
FIG. 8 is a back view of a unit of the unit.

FIGS. 1 through 3 show tables 1 assembled using the system. Each table may comprise at least one unit 2 of the system and a table top 3. The table top 3 may be one or more pieces of plexiglass or any other desired material and may be ¼ inch thick and 24 inches wide or any other desired size. The length of the table top 3 may be dependent on the desired design and the length of the units 2 to be used. To provide stability, the units 2 may be connected to each other and the table top 3 may be connected to the units 2 via one or more connection device 4. The connection devices 4 may be any desired connection device. For example, the connection devices 4 may be metal glass connectors, as shown in FIGS. 2 and 3. This may create a "ghost table" effect.

Each of the units 2 may have a generally rectangular cuboid shape. Each unit 2 may comprise a front panel 5, a back panel 6, a top panel 7, a bottom panel 8, a right-side panel 9, and a left-side panel 10. The panels 5 through 10 may be made of expanded polyvinyl chloride, HDPE, seaboard (marine grade), wood, plexiglass, Styrofoam, metal such as but not limited to aluminum, or any other desired material or combination of materials. The back panel 6, top panel 7, bottom panel 8, and side panels 9 and 10 may each be generally flat and rectangular. The top panel 7 and bottom panel 8 may have the same dimensions; the right-side panel 9 and left-side panel 10 may have the same dimensions; and the side panels 9 and 10 and the back panel 6 may have the same height, such that the unit 2, when assembled, forms a hollow cuboid. Within a single system, each unit 2 may have the same height and the same side panel width, allowing multiple units 2 to be aligned, side by side, to form a single elongate structure with a flat top, a flat bottom, a flat back, and a flat front, as shown in FIGS. 1 through 3. The units 2 may not all have the same width.

The front panel 5 may be generally flat and may have an overall height and width equal to that of the back panel 6, but may not be rectangular. Rather, the front panel 5 may have any desired shape and/or design, such as a letter, number, symbol, or shape. For example, the individual units 2 shown in FIG. 1 have a variety of front panel 5 shapes, including the letters M, R, S, and L, the symbol &, and a heart shape. Each of these shapes may be flat and solid within the shape, with the area outside the shape omitted. Alternately, the front panel 5 may be a light-permeable or semi-permeable membrane, such as velum, which may have image printed thereon. Regardless of the shape of the front panel 5, each may have the same overall height and width of the back panel 6, allowing the front panel 5 to connect to the top panel 7 at at least one point; the bottom panel 8 at at least one point, the right-side panel 9 at at least one point; and the left-side panel 10 at at least one point.

Figure 9:
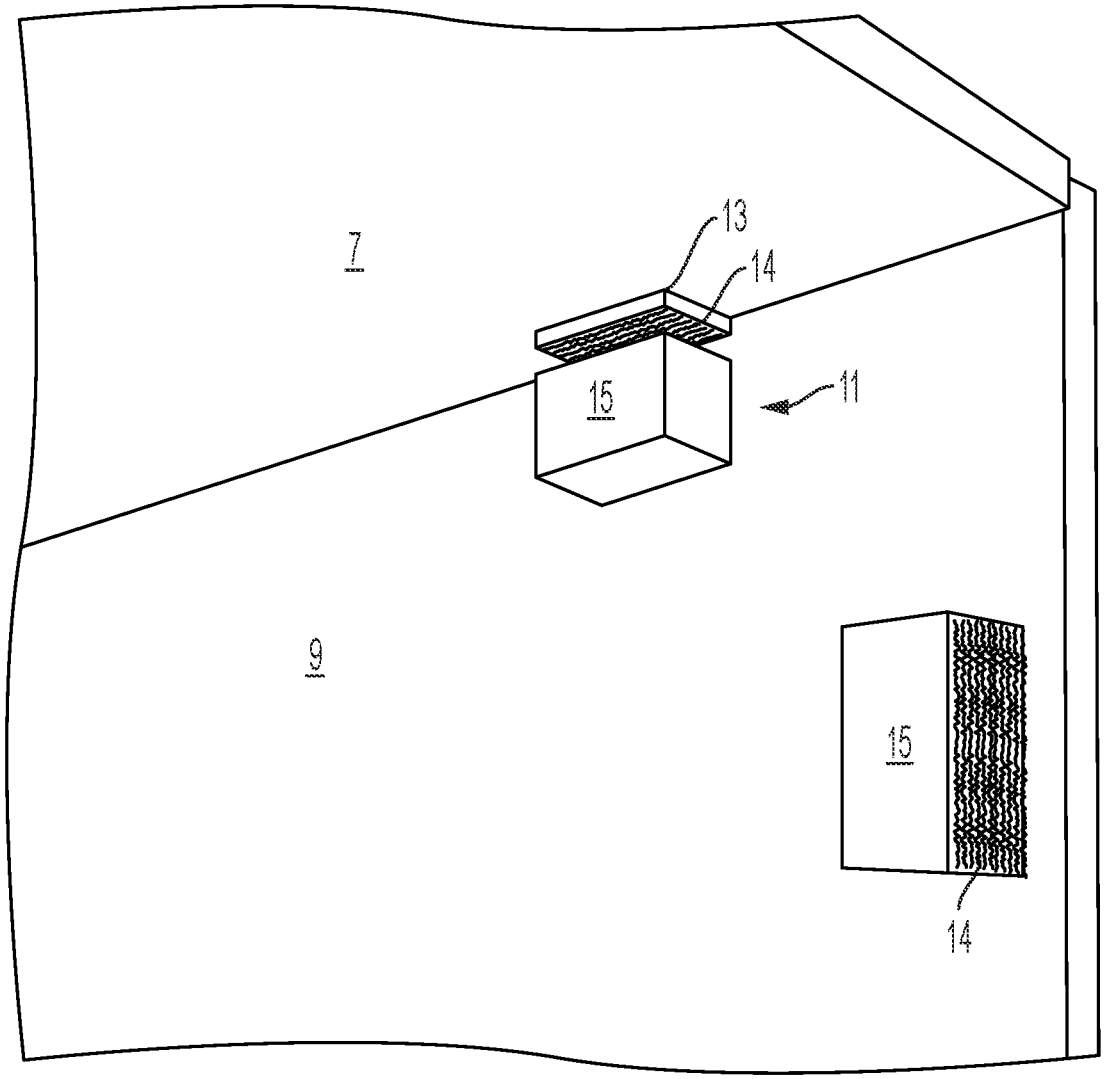
FIG. 9 is a close-up view of a connection system for assembling the unit.
Figure 10:
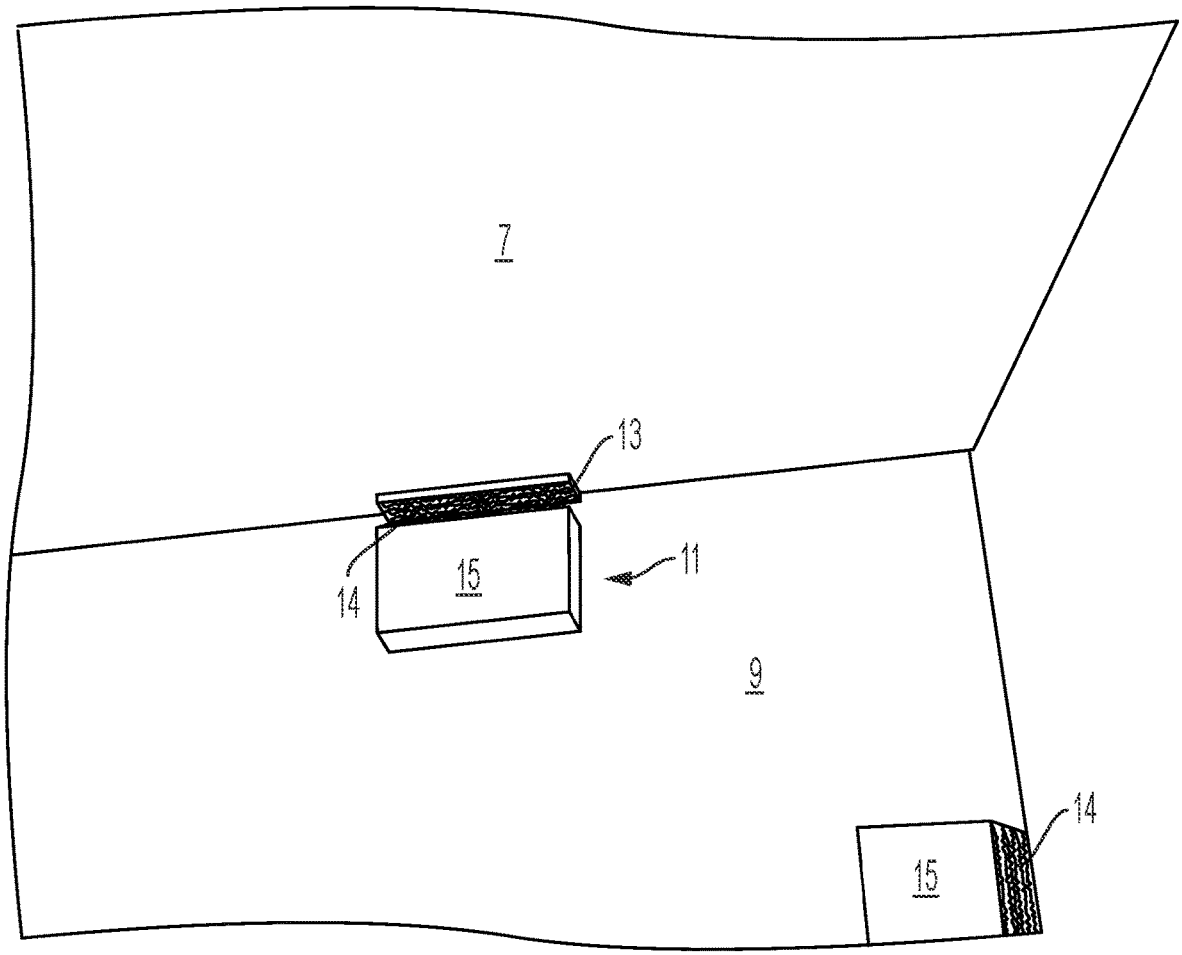
FIG. 10 is another close-up view of a connection system for assembling the unit.
Figure 11:
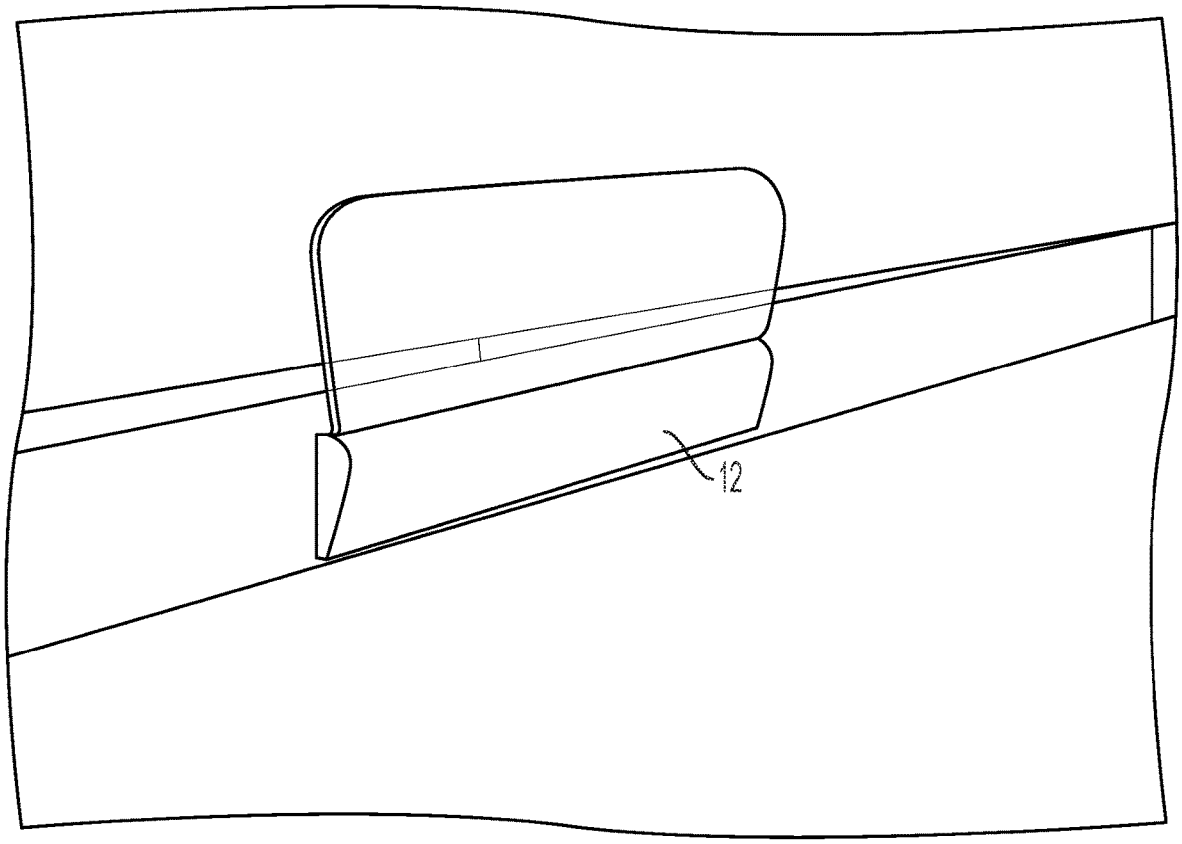
FIG. 11 is a perspective view of a hinge for folding the unit.

Each of the panels may connect to contiguous panels of the same unit 2 via one or more connection devices. The connection devices may each be permanent or temporary/removable and may each be flexible or fixed, and multiple types of connection devices may be used on the same unit 2. For example, as shown, a single unit 2 may comprise both one or more temporary/removable connectors 11 and one or more hinges 12. The connectors 11 may connect panels temporarily when the unit 2 is in use, but may be able to disconnect to allow the panels to be separated so that the unit 2 may folded when not in use. For example, as shown in FIG. 9, the connectors 11 may each comprise a first side 13 and a second side 14, where the first side 13 and the second side 14 are removably connectable. The first side 13 may attach directly to one of the panels 5 through 10, while the second side 14 may attach to a contiguous panel 5 through 10 via a block 15 or other spacer to allow the second side 14 to lie perpendicular to the panel to which it is attached, allowing the second side 14 to connect to the first side 13 with the panels to which the first side 13 and the second side 14 are attached are at a right angle. The connectors 11 may be any desired temporary/removable connectors, including but not limited to reclosable fasteners, dual lock fasteners, hook and loop fasteners, magnets, any other desired connector, or any combination thereof. For example, as shown in FIGS. 9 and 10, the connectors 11 may be dual lock 250 stem density polyolefin fastener.

Figure 12:
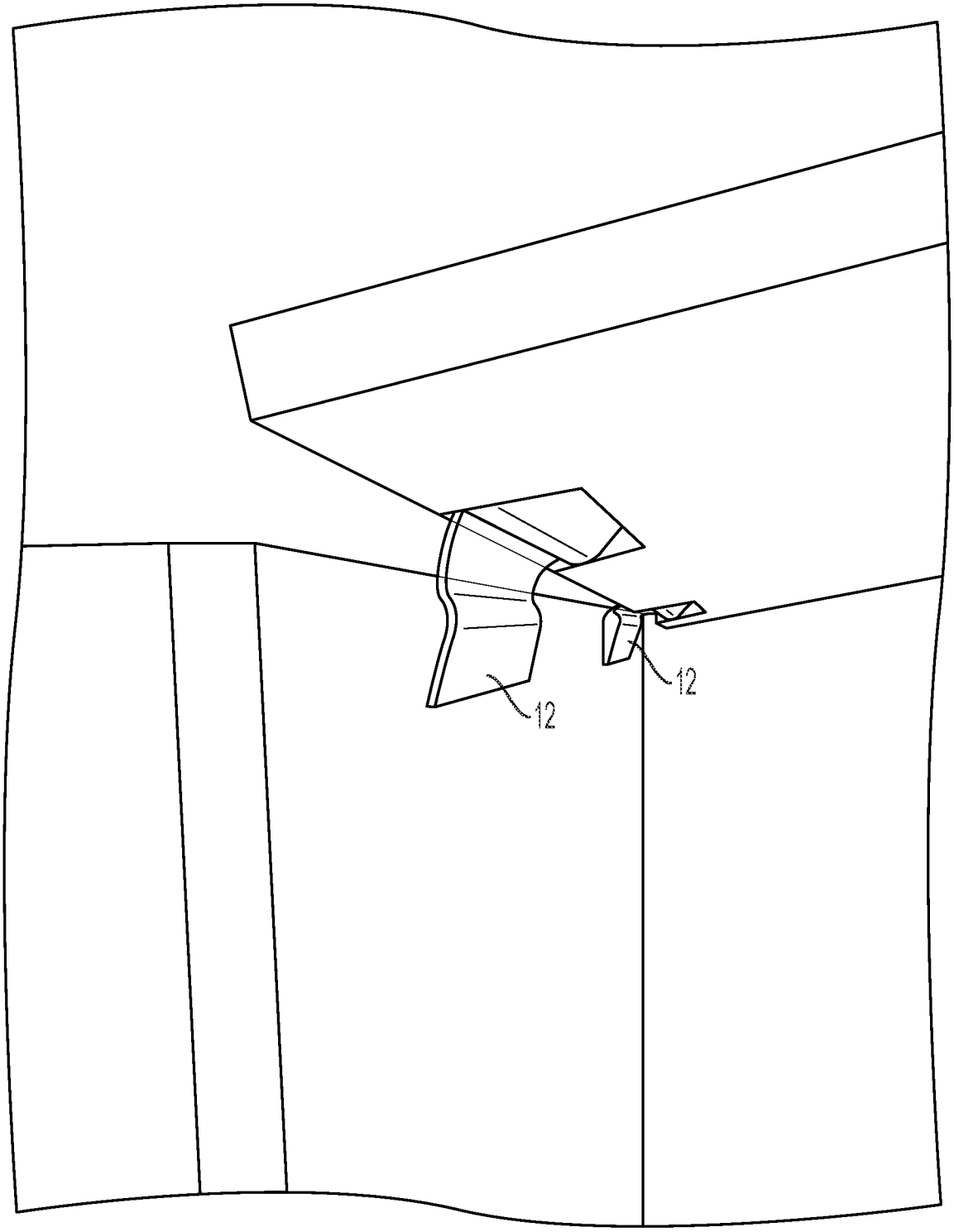
FIG. 12 is a perspective view of the hinge in an alternate position.
Figure 13:
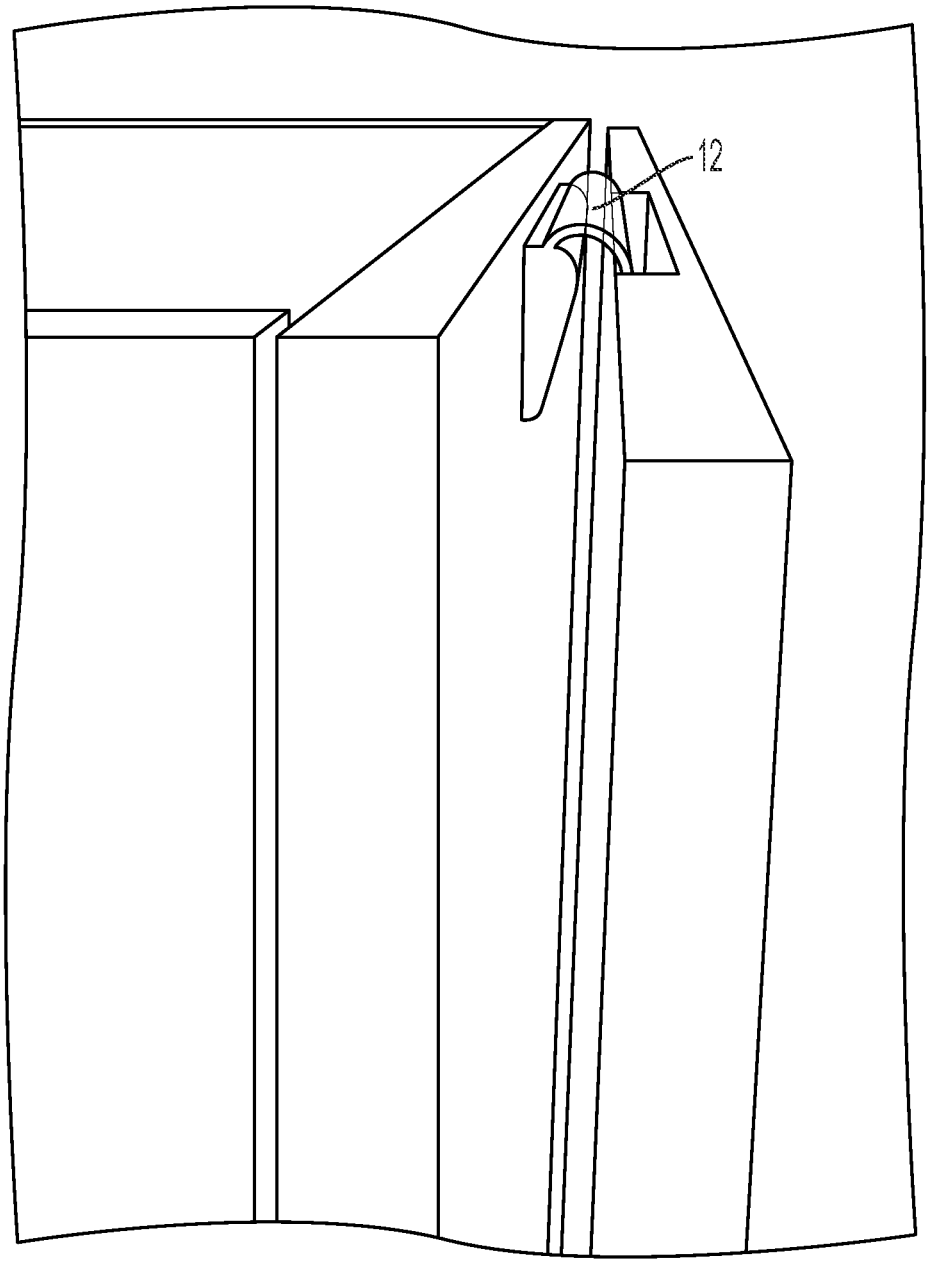
FIG. 13 is a perspective view of the hinge in another alternate position.
Figure 14:
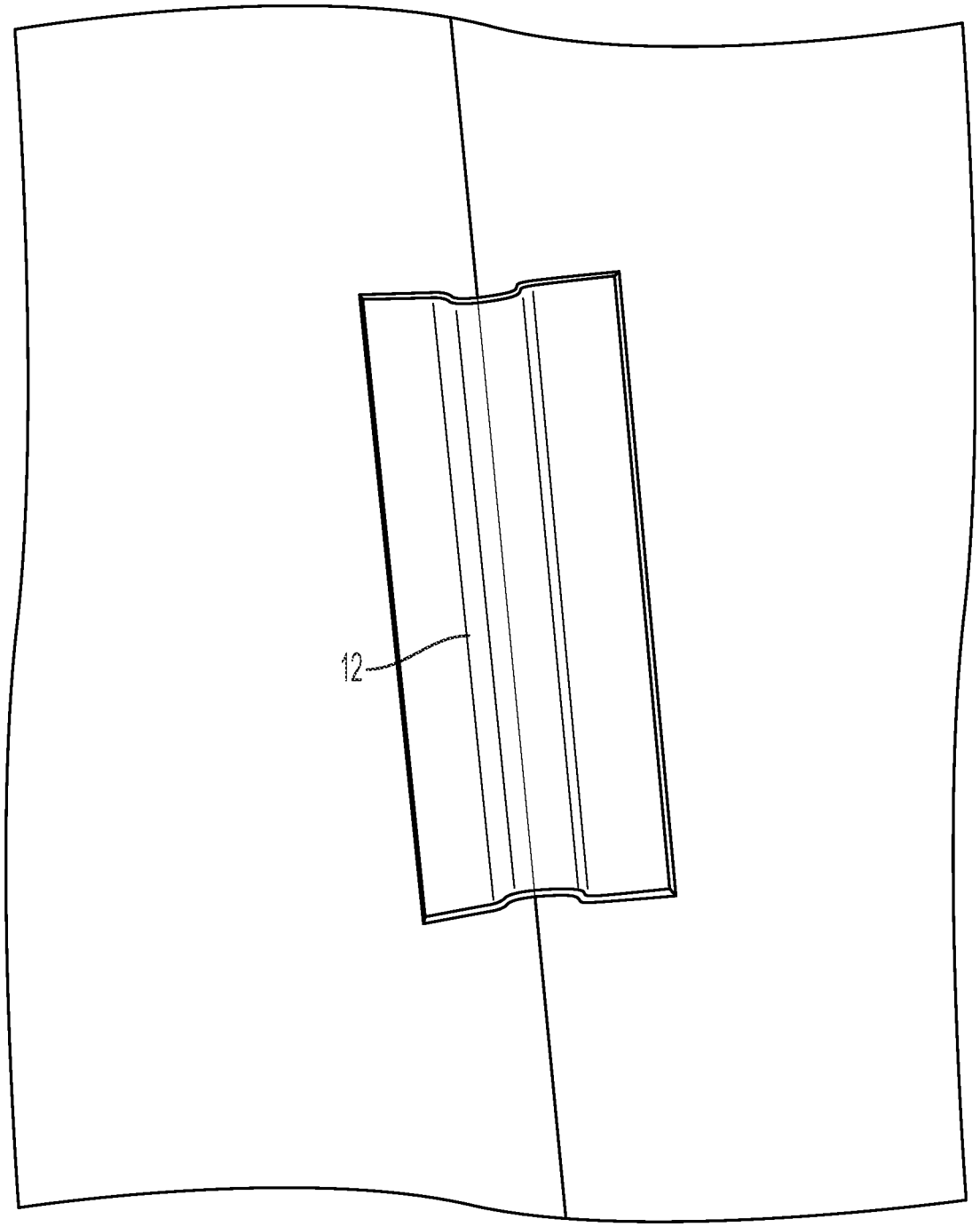
FIG. 14 is a perspective view of another hinge for folding the unit.
Figure 15:
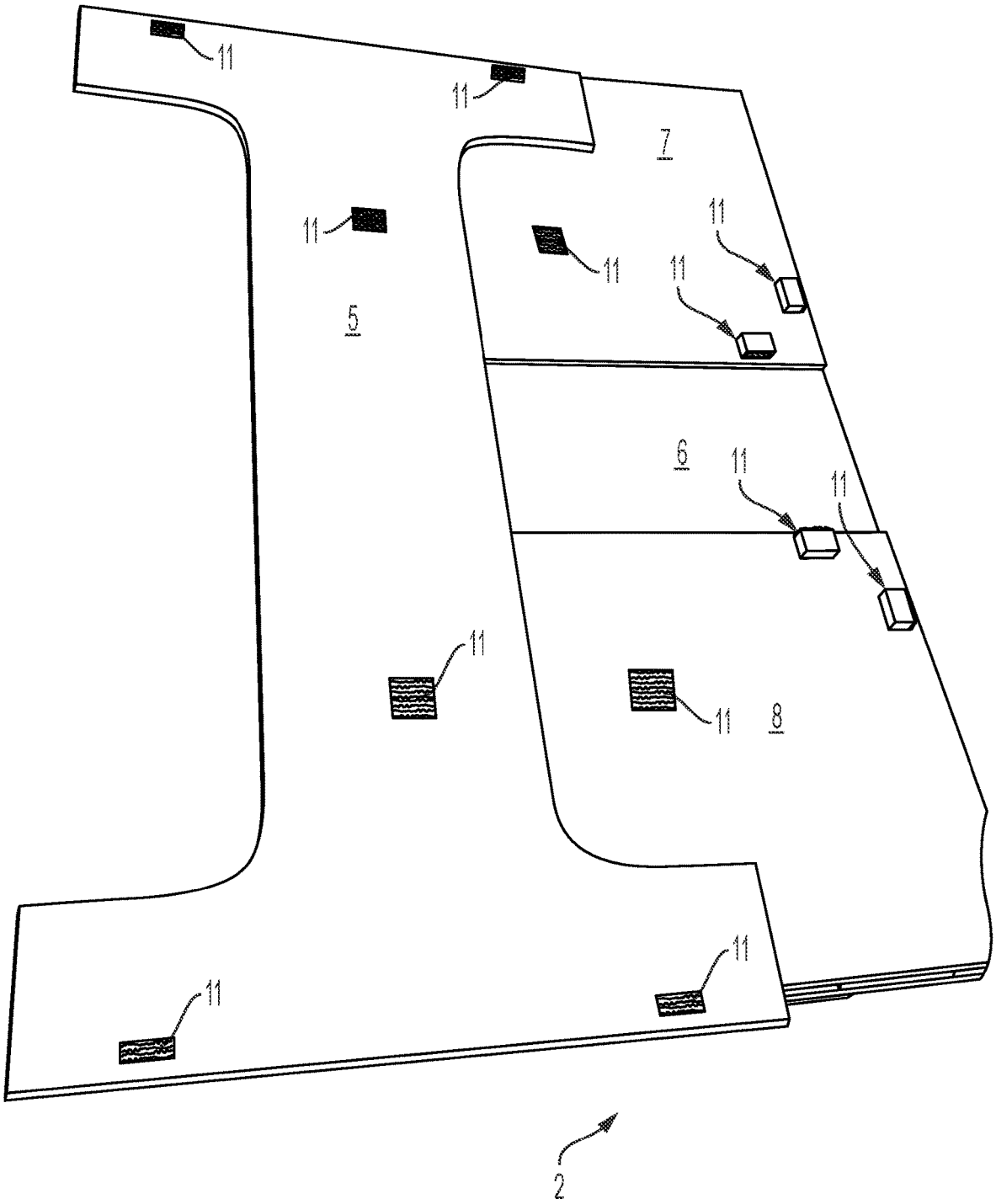
FIG. 15 is a front view of a unit of the system in a folded position.

The hinges 12 may be any desired type of hinges or combination of types of hinges, such as PVC flex living hinge, Hytrel living hinge, thermoplastic hinge, acrylic hinge, or other desired hinge. For example, the hinges 12 may be living hinges, as shown in FIGS. 11 through 14. Each hinge 12 may be a flexible piece of plastic material molded between two rigid pieces. Each of the hinges 12 may have a first side attached to one of the panels 6 through 10 and a second side attached to another of the panels 6 through 10, where the two panels are contiguous during use of the unit 2. The hinges 12 may be capable of allowing the contiguous panels to pivot from a right angle when the unit 2 is in use to a folded position with the panels lying one atop the other on their respective faces. The hinges 12 may be located on the outside of the unit 2 when in use, as shown in FIGS. 12 and 13, or on the inside of the unit 2 when in use, as shown in FIG. 14, depending on how the unit 2 is folded to reach the folded position.

Figure 16:
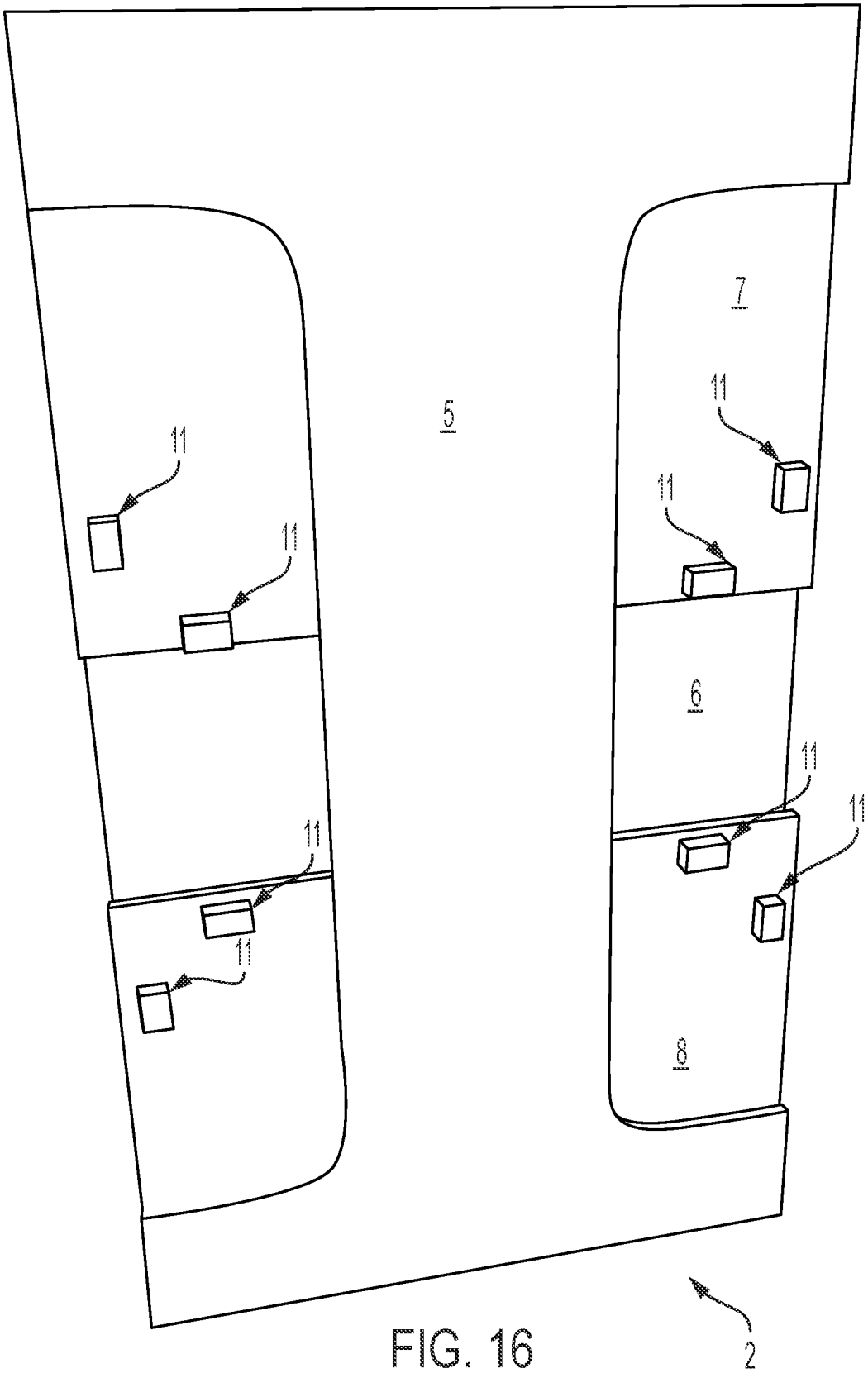
FIG. 16 is a front view of the unit in a storage position.
Figure 17:
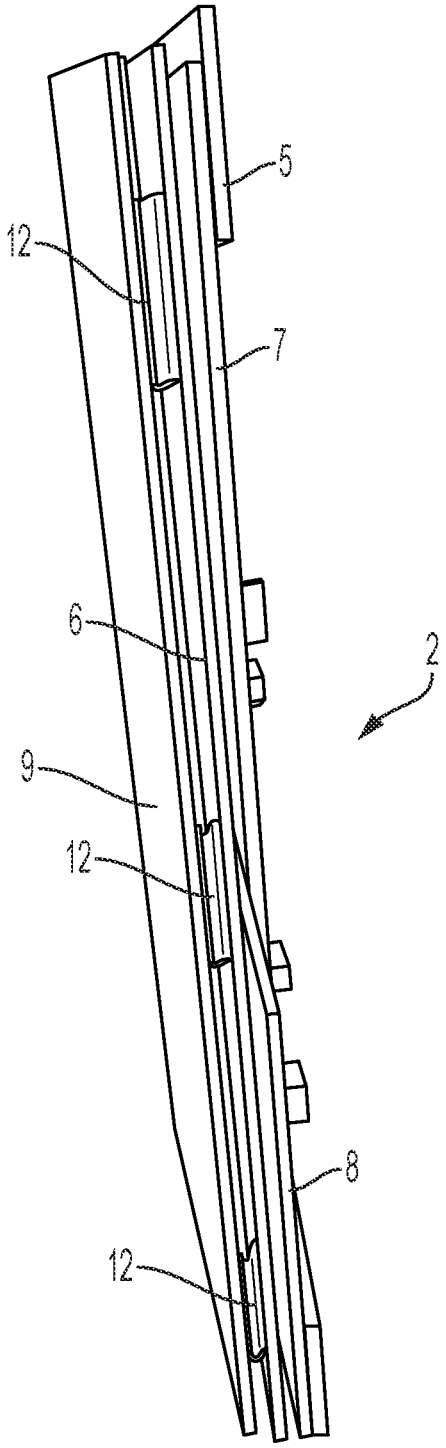
FIG. 17 is a side view of the unit in the storage position.
Figure 18:
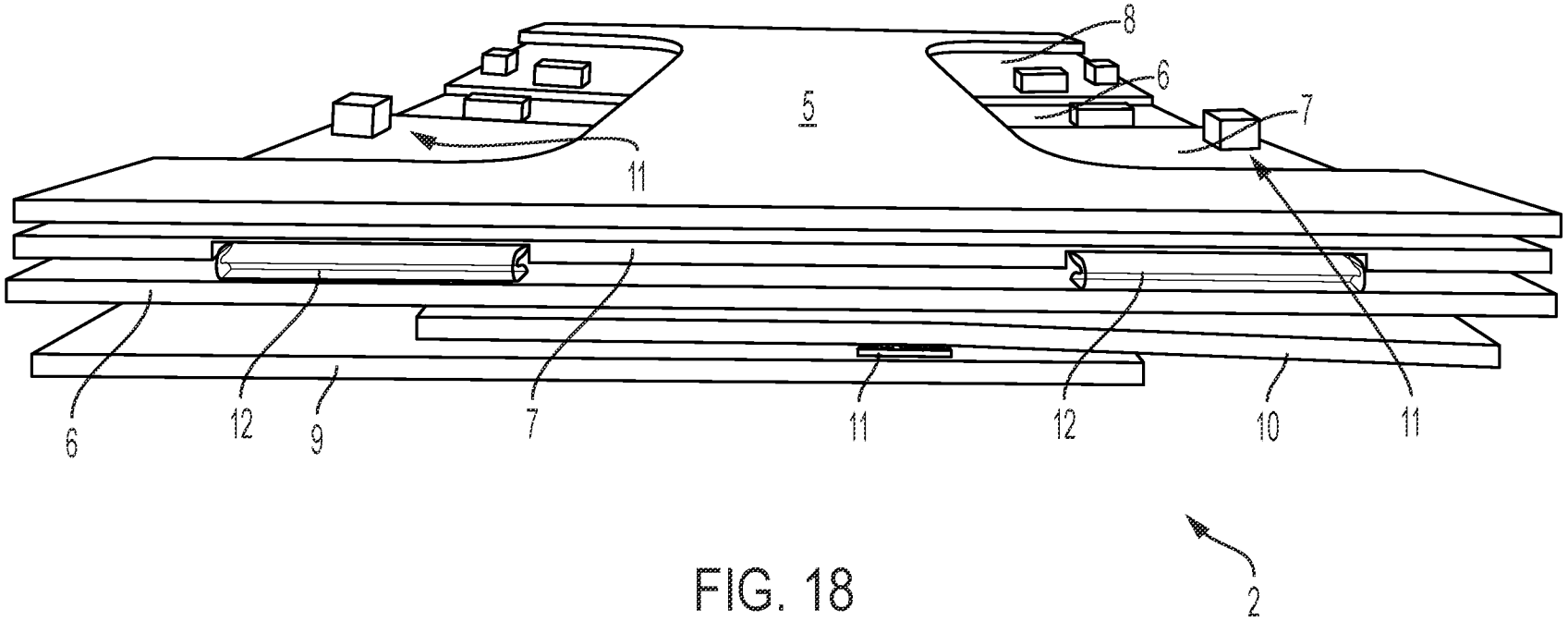
FIG. 18 is a top view of the unit in the storage position.

When the unit 2 is not in use, it may be folded for storage and transport. The front panel 5 may be removed, the connectors 11 may be disconnected, and the panels 6 through 10 may be folded at the hinges 12 to reach the folded position, as shown in FIGS. 15 through 18. In particular, the top panel 7 and bottom panel 8 may fold back and the side panels 9 and 10 may fold forward. The front panel 5 may be connected to the remainder of the unit 2 via additional temporary/removable connectors 11, shown in FIG. 15, if desired to ensure that the unit 2 remains together during storage and transport. FIGS. 16 through 18 show a unit 2 fully folded from different angles, with the front panel 5 attached as described above.

During use, the user may decide what message or other design to display with the system, and may select one or more appropriate units 2 accordingly. The user may assemble each unit 2 by removing the front panel 5, unfolding the remaining panels 6 through 10 and securing them in a cuboid shape via connectors 11. The front panel 5 may likewise be connected via connectors 11. Multiple units 2 may be connected together in the desired pattern and the table top 3 may be connected to the units 2 via the connection devices 4. The units 2 may each be lit from within by a light source 16, creating a shadowbox effect. The light source 16 may be any desired light source 16. For example, the light source 16 may be a remote-controlled battery-powered LED light capable of multiple colors and/or effects, allowing the user to customize the effect based on the desired color scheme or theme of the event or venue.

Whereas, the devices and methods have been described in relation to the drawings and claims, it should be understood that other and further modifications, apart from those shown or suggested herein, may be made within the spirit and scope of this invention.

What is claimed is:

1. A modular system for customized tables and other decorations, the system comprising:

a plurality of units, where each unit has a rectangular cuboid shape when assembled, is hollow, and comprises a front panel with a decorative shape; and at least one table top;

where each unit in the system has the same height and depth and where the units are capable of being used in combination and where the plurality of units are capable of being aligned side-by-side in a row with the table top resting atop the units.

2. The modular system of claim 1 where the decorative shape of each front panel is a letter, a number, a symbol, or a shape.

3. The modular system of claim 1 where the table top is connected to at least one of the units.

4. The modular system of claim 1 where the table top is glass, the system further comprising at least one metal glass connector capable of connecting the table top to at least one of the units.

5. The modular system of claim 1 where each unit is foldable.

6. The modular system of claim 5 where each unit further comprises:

a bottom panel, where the bottom panel:

is flat and rectangular; and has a right side, a left side, a front side, and a back side;

a top panel with the same dimensions as the bottom panel, where the top panel:

is flat and rectangular; and has a right side, a left side, a front side, and a back side;

a right-side panel, where the right-side panel:

is flat and rectangular; and has a front side, a back side, a top side, and a left side;

where the top side of the right-side panel is removably connected to the right side of the top panel and the bottom side of the right-side panel is removably connected to the right side of the bottom panel;

a left-side panel with the same dimensions as the right-side panel, where the left-side panel:

is flat and rectangular; and has a front side, a back side, a top side, and a left side;

where the top side of the left-side panel is removably connected to the left side of the top panel and the bottom side of the left-side panel is removably connected to the left side of the bottom pane; and a back panel with the same width as the top and bottom panels and the same height as the right-side and left-side panels, where the back panel:

is flat and rectangular; and has a top side, a bottom side, a right side, and a left side;

where the top side of the back panel is connected to the back side of the top panel, the bottom side of the back panel is connected to the back side of the bottom panel, the right side of the back panel is connected to the back side of the right-side panel, and the left side of the back panel is connected to the back side of the left-side panel.

7. The modular system of claim 6 where the back panel is connected to the top panel, the bottom panel, the right-side panel, and the left-side panel via a plurality of hinges.

8. The modular system of claim 7 where the hinges are living hinges.

9. The modular system of claim 6 where the side panels are removably connected to the top and bottom panels via a plurality of reclosable fasteners.

10. The modular system of claim 6 where the front panel has the same width as the back, top, and bottom panels and the same height as the back, right-side, and left-side panels and is removably connected to:

the front side of the top panel at at least one point;

the front side of the bottom panel at at least one point;

the front side of the right-side panel at at least one point; and the front side of the left-side panel at at least one point.

11. The modular system of claim 1 further comprising a plurality of light sources, where each unit has a light source within the unit capable of backlighting the decorative shape of the front panel.

12. The modular system of claim 11 where the plurality of light sources are a plurality of battery-powered LED dome lights.

13. A modular system for customized tables and other decorations, the system comprising:

a plurality of units, where each unit has a rectangular cuboid shape when assembled, is hollow, and comprises a front panel with a decorative shape;

where each unit in the system has the same height and depth and where the units are capable of being used in combination;

where each unit further comprises:

a bottom panel, where the bottom panel:

is flat and rectangular; and has a right side, a left side, a front side, and a back side;

a top panel with the same dimensions as the bottom panel, where the top panel:

is flat and rectangular; and has a right side, a left side, a front side, and a back side;

a right-side panel, where the right-side panel:

is flat and rectangular; and has a front side, a back side, a top side, and a left side;

where the top side of the right-side panel is removably connected to the right side of the top panel and the bottom side of the right-side panel is removably connected to the right side of the bottom panel;

a left-side panel with the same dimensions as the right-side panel, where the left-side panel:

is flat and rectangular; and has a front side, a back side, a top side, and a left side;

where the top side of the left-side panel is removably connected to the left side of the top panel and the bottom side of the left-side panel is removably connected to the left side of the bottom pane; and a back panel with the same width as the top and bottom panels and the same height as the right-side and left-side panels, where the back panel:

is flat and rectangular; and has a top side, a bottom side, a right side, and a left side;

where the top side of the back panel is connected to the back side of the top panel, the bottom side of the back panel is connected to the back side of the bottom panel, the right side of the back panel is connected to the back side of the right-side panel, and the left side of the back panel is connected to the back side of the left-side panel;

where the side panels are removably connected to the top and bottom panels via a plurality of reclosable fasteners and the front panel is removably connected to the top, bottom, and side panels via a plurality of reclosable fasteners.

* * * * *